US008704718B2

(12) United States Patent
Guler

(10) Patent No.: US 8,704,718 B2
(45) Date of Patent: Apr. 22, 2014

(54) WAVEGUIDE TO DIPOLE RADIATOR TRANSITION FOR ROTATING THE POLARIZATION ORTHOGONALLY

(75) Inventor: Michael G. Guler, Dawsonville, GA (US)

(73) Assignee: Honeywell International Inc., Morristown, NJ (US)

( * ) Notice: Subject to any disclaimer, the term of this patent is extended or adjusted under 35 U.S.C. 154(b) by 576 days.

(21) Appl. No.: 12/882,897

(22) Filed: Sep. 15, 2010

(65) Prior Publication Data

US 2011/0063053 A1 Mar. 17, 2011

Related U.S. Application Data

(60) Provisional application No. 61/242,414, filed on Sep. 15, 2009.

(51) Int. Cl.
*H01Q 9/16* (2006.01)
*H01P 1/165* (2006.01)
*H01P 5/02* (2006.01)

(52) U.S. Cl.
USPC ..... 343/727; 343/795; 343/822; 343/772; 333/21 A; 333/34

(58) Field of Classification Search
USPC ..... 333/26, 21 A, 34; 343/727, 772, 776, 343/795, 821, 822
See application file for complete search history.

(56) References Cited

U.S. PATENT DOCUMENTS

| | | | | | |
|---|---|---|---|---|---|
| 3,623,112 | A | * | 11/1971 | Rupp et al. | 343/727 |
| 4,298,878 | A | * | 11/1981 | Dupressoir et al. | 343/795 |
| 4,905,013 | A | * | 2/1990 | Reindel | 343/786 |
| 5,184,095 | A | * | 2/1993 | Hanz et al. | 333/33 |
| 6,265,950 | B1 | * | 7/2001 | Schmidt et al. | 333/26 |
| 2007/0024517 | A1 | * | 2/2007 | Shimoda | 343/795 |

* cited by examiner

*Primary Examiner* — Benny Lee
(74) *Attorney, Agent, or Firm* — Fogg & Powers LLC

(57) ABSTRACT

A radiating element having a transition from a waveguide to a dipole radiator. The radiating element utilizes the electric field of electromagnetic waves propagating in the waveguide to excite a section of a microstrip transmission line that is collinear with the waveguide's propagation direction. A waveguide septum guides the electric field of the electromagnetic waves into the transmission line and provides impedance matching. The transmission line can be formed on a first side of a dielectric substrate having a ground plane on a second side of the substrate. A first dipole leg is formed by making a ninety degree turn in the transmission line. A second dipole leg is extended from the ground plane and turned opposite from the first dipole leg. The transmission line includes a transformer having stepped or gradual changes in width of the transmission line leading to the dipole to provide additional impedance matching.

28 Claims, 7 Drawing Sheets

WAVEGUIDE TO DIPOLE RADIATOR TRANSITION FOR ROTATING THE POLARIZATION ORTHOGONALLY

RELATED PATENT APPLICATION

This non-provisional patent application claims priority under 35 U.S.C. §119 to U.S. Provisional Patent Application No. 61/242,414, entitled, "Waveguide-to-Dipole Transition," filed Sep. 15, 2009, the entire contents of which are hereby fully incorporated herein by reference.

TECHNICAL FIELD

The present disclosure relates generally to radiating electromagnetic energy, and more particularly to a waveguide to dipole transition of electromagnetic radiation.

BACKGROUND

An important parameter of a propagating electromagnetic wave is its polarization, which is the orientation of the electromagnetic wave's electric field in the plane perpendicular to the direction of propagation. Polarization is commonly used to increase data capacity of a given band of frequencies. Thus, techniques for controlling and manipulating polarization are important to radio communications.

Open-ended waveguides and slots cut through waveguide walls are often used to radiate radio waves. The open end (or slots) of the waveguide typically has a rectangular shape with dimensions of about one-half wavelength of the propagating electromagnetic wave in the long dimension and about one-fourth wavelength or less in the short dimension. This results in linear polarized radiation oriented along the short dimension.

In order to rotate polarization in a waveguide transmission line, the waveguide is typically twisted gradually, or stepped, about the axis of propagation. As a typical waveguide has a rectangular profile with a larger width than height, the twisting results in a new aspect ratio. For example, a ninety degree twist in a waveguide that starts with a width-to-height aspect ratio of a/b, and ends with a width-to-height aspect ratio of b/a. This can preclude the use of a waveguide in certain applications where the aspect ratio is critical, such as in certain volume constrained applications.

Thus, a need exists in the art for systems and methods that overcome one or more of the above-described limitations.

SUMMARY

The invention facilitates rotating an electromagnetic wave's polarization while maintaining a transmission media's aspect ratio and area of cross section. A radiating element can include a transition from a waveguide, such as a waveguide transmission line or slot in a waveguide wall, to a dipole radiator. The radiating element can utilize the electric field of electromagnetic waves propagating in the waveguide to excite a section of a stripline or microstrip transmission line that is collinear with the waveguide's propagation direction. A waveguide septum can guide the electric field of the electromagnetic waves into the transmission line and also provide impedance matching. The transmission line can be formed on a dielectric substrate. The dielectric substrate can also include a ground plane, for example on a side of the substrate opposite the transmission line. A first dipole leg can be formed by making a ninety degree turn in the transmission line. A second dipole leg can be extended from the ground plane and turned opposite from the first dipole leg. The transmission line can include a transformer having stepped or gradual changes in width of the transmission line leading to the dipole to provide additional impedance matching.

An aspect of the present invention provides a waveguide to dipole transition. The waveguide to dipole transition can include a waveguide transmission line. A first transition can be positioned with respect to the waveguide transmission line to propagate electromagnetic energy between the waveguide transmission line and an electrical transmission line. A second transition can be positioned with respect to the first transition to propagate electromagnetic energy between the electrical transmission line and a dipole radiator.

Another aspect of the present invention provides a waveguide to dipole transition. The waveguide to dipole transition can include a waveguide having a channel and an opening at one end. An electrical transmission line can be formed on a first side of a dielectric substrate that is attached to the waveguide. A ground plane can cover at least a portion of a second side of the dielectric substrate. A dipole radiator can include a first dipole leg formed from an end segment of the electrical transmission line and a second dipole leg formed from an electrical conductor electrically coupled to the ground plane.

Yet another aspect of the present invention provides a method for rotating polarization of electromagnetic energy. The method can include electromagnetic energy having a first polarization propagating in a waveguide. At least a portion of the electromagnetic energy can be transitioned from the waveguide to an electrical transmission line. The portion of the electromagnetic energy can be transitioned from the electrical transmission line to a dipole radiator. The dipole radiator can radiate the portion of electromagnetic energy with electric field in a second polarization state.

Yet another aspect of the present invention provides a method for rotating polarization of electromagnetic energy. The method includes a dipole antenna receiving electromagnetic energy having a first polarization. At least a portion of the electromagnetic energy can be transitioned from the dipole antenna to an electrical transmission line with electric field in a second polarization state. The portion of the electromagnetic energy can be transitioned from the electrical transmission line to a waveguide transmission line. The waveguide transmission line can transport the energy to a desired position.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
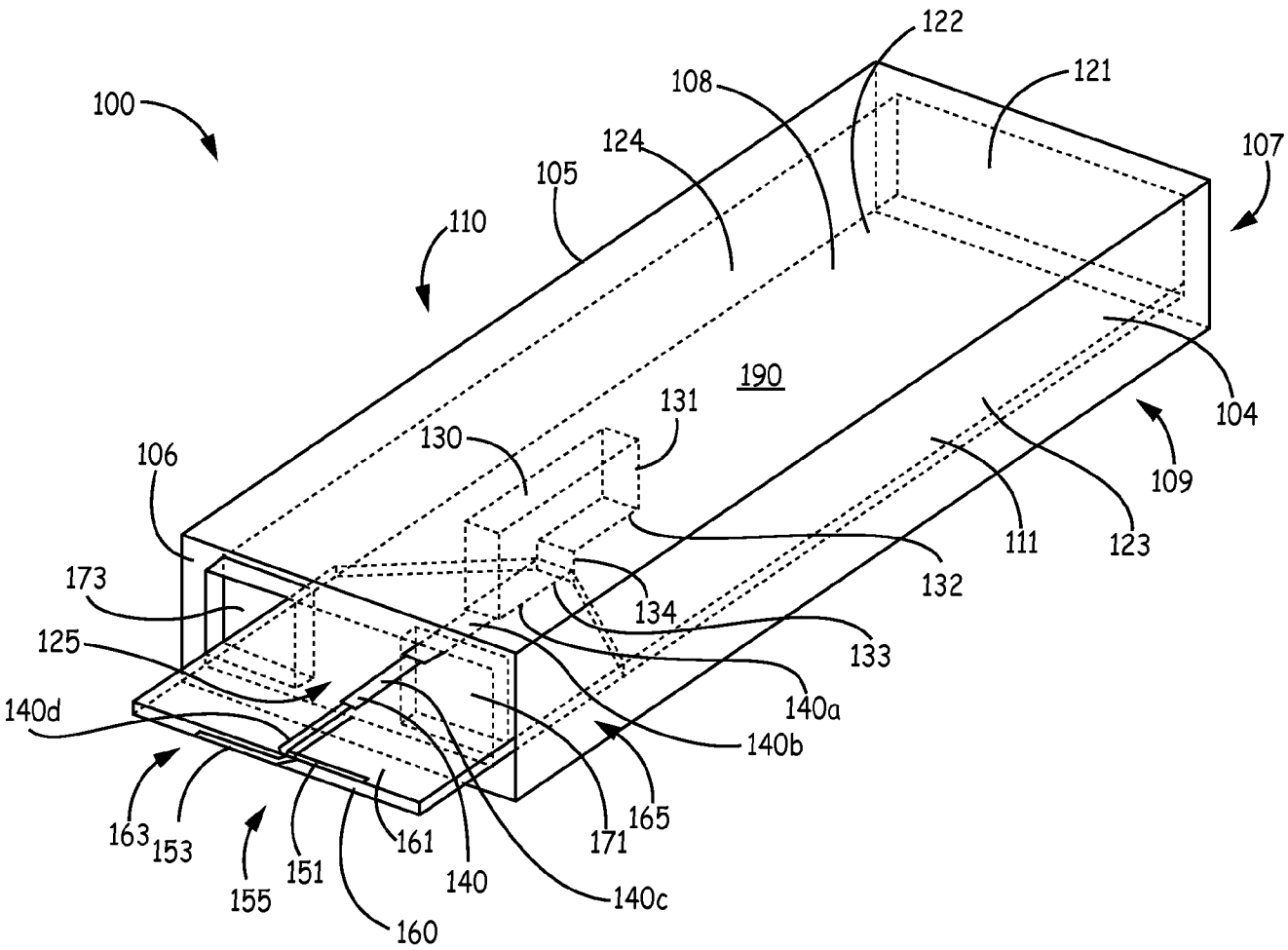
FIG. 1 is a side perspective view of a radiating element having a waveguide to dipole transition, in accordance with certain exemplary embodiments.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles.

DETAILED DESCRIPTION OF THE EXEMPLARY EMBODIMENTS

Exemplary embodiments provide a radiating element having a transition from a waveguide, such as a waveguide transmission line or slot in a waveguide wall, to a dipole radiator. The radiating element can include a first transition from the waveguide to an electrical transmission line and second transition from the electrical transmission line to a dipole radiator.

The radiating element can utilize the electric field of electromagnetic waves propagating in the waveguide to excite a section of a stripline or microstrip transmission line that is collinear with the waveguide's propagation direction. A waveguide septum can guide the electric field of the electromagnetic waves into the transmission line and also provide impedance matching. The waveguide septum can provide a gradual or step-wise reduction of open space above the transmission line for guiding the electric field of the electromagnetic waves into the transmission line.

The transmission line can be formed on a first side of a dielectric substrate and a ground plane can cover at least a portion of a second side of the dielectric substrate, opposite the first side. The transmission line can include a transformer having stepped or gradual changes in width of the transmission line leading to the dipole radiator to provide additional impedance matching. The width of the transmission line can increase or decrease leading to the dipole radiator to create the transformer.

A first dipole leg can be formed by making a ninety degree turn in the transmission line. A second dipole leg can be extended from the ground plane and turned opposite from the first dipole leg. The transmission line and ground plane can extend out of an aperture in the waveguide such that the radiating dipole is external to the waveguide. Fences can be disposed in the region where the transmission line exits the waveguide to prevent cross-polarized radiation from exiting the waveguide.

Exemplary radiating elements having a waveguide to dipole transition can rotate the polarization of an electromagnetic wave propagating in the waveguide. For example, the radiating element can be configured to provide a 90 degree rotation of the electromagnetic wave's polarization. The radiating element can also rotate the polarization (e.g., by 90 degrees) of an electromagnetic wave received by the dipole radiator. These rotations can be achieved in a short distance, while maintaining the aspect ratio and cross section of the radiating element's aperture. Thus, exemplary radiating elements having a waveguide to dipole transition can be used to rotate polarization in volume constrained applications, such as in monopulse feed applications for reflector antenna systems. Another exemplary application of radiating elements having a waveguide to dipole transition is to rotate polarization in slot radiators. In arrays of radiators, spacing between rows may not permit the orientation of the slot radiator for proper polarization. In these cases, a transition from waveguide to a dipole radiator enables the desired element spacing and polarization.

The following description of exemplary embodiments refers to the attached drawings. Any spatial references herein such as, for example, "upper," "lower," "above," "below," "rear," "between," "vertical," "angular," "beneath," "top," "bottom," "left," "right," etc., are for the purpose of illustration only and do not limit the specific orientation or location of the described structure. Although the following exemplary embodiments may be described largely in terms of an electromagnetic signal propagating in a certain direction, this does not limit the present invention from applying to signals propagating in the opposite direction. That is, the present invention applies equally well to transmit or receive applications.

Figure 2:
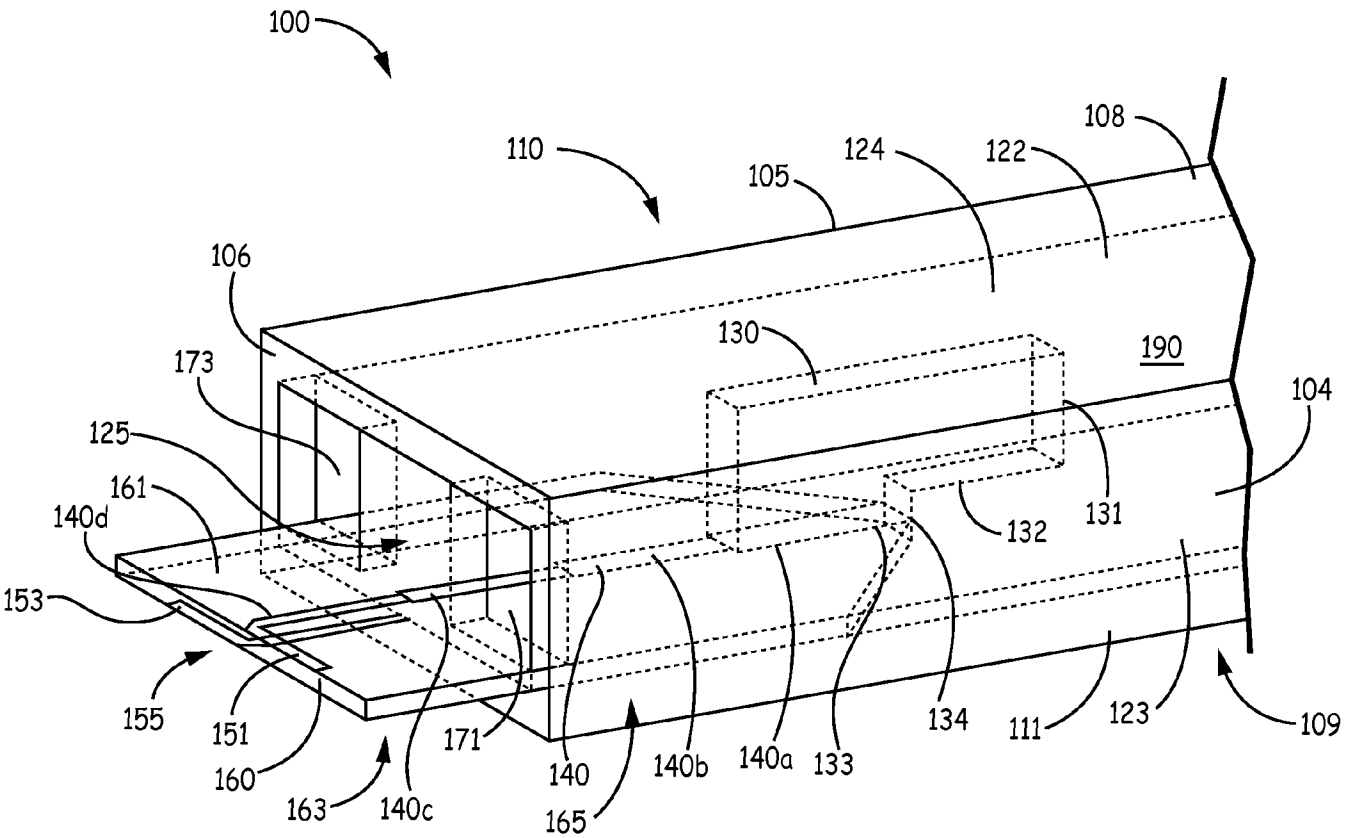
FIG. 2 is a side perspective view of a portion of the radiating element of FIG. 1, in accordance with certain exemplary embodiments.
Figure 3:
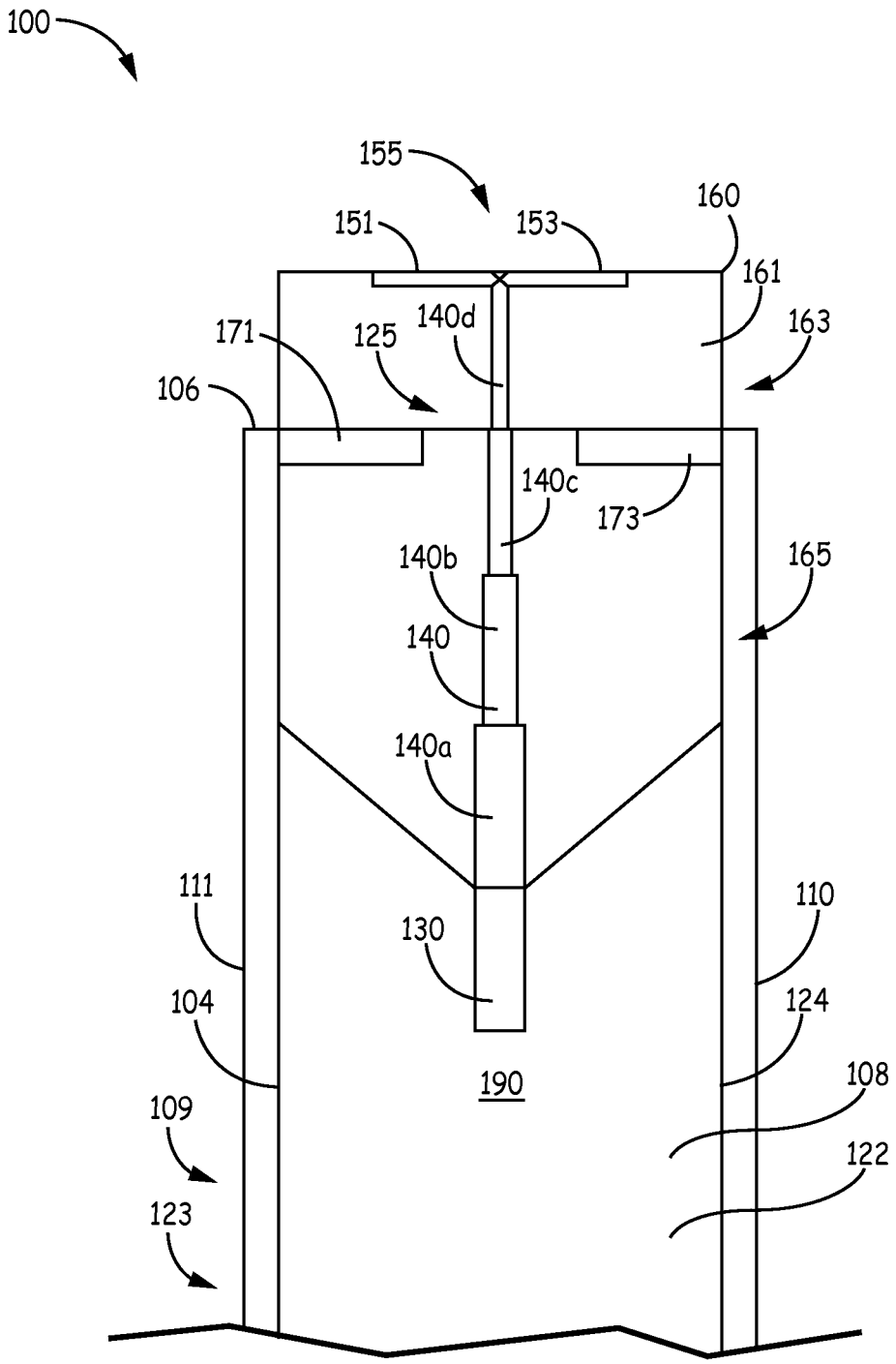
FIG. 3 is a top view of a portion of the radiating element of FIG. 1, in accordance with certain exemplary embodiments.

Turning now to the drawings, in which like numerals represent like (but not necessarily identical) elements throughout the figures, exemplary embodiments of the present invention are described in detail. FIGS. 1-3 provide several views of an exemplary radiating element 100 having a waveguide to dipole transition, in accordance with certain exemplary embodiments. In particular, FIG. 1 is a side perspective view of the exemplary radiating element 100; FIG. 2 is a side perspective view of a portion of the radiating element 100; and FIG. 3 is a top view a portion of the radiating element 100.

Referring to FIGS. 1-3, the radiating element 100 includes a waveguide transmission line ("waveguide") 105 (FIGS. 1 & 2) having an aperture or opening 125 in a front end 106. The exemplary waveguide 105 has the shape of a rectangular prism, although other shapes may be used without departing from the scope and spirit of the present invention. The waveguide 105 includes outer sidewalls 110 and 111, an outer upper wall 108, an outer lower wall 109, and an outer rear end 107 (FIG. 1) opposite the front end 106. In certain exemplary embodiments, the outer sidewalls 110 and 111 each have a substantially rectangular shape and are substantially in parallel. Similarly, the outer upper wall 108 and the outer lower wall 109 each have a substantially rectangular shape and are substantially in parallel. The outer rear end 107 can include an opening 121 (FIG. 1) for receiving or transmitting electromagnetic energy, for example in the form of a TE10 mode electromagnetic field.

The waveguide 105 generally defines a rectangular channel 190 throughout its interior to conduct electromagnetic energy. The rectangular channel 190 is defined by inner sidewalls 124 and 104, inner upper wall 122, and an inner lower wall 123. In certain exemplary embodiments, the inner sidewalls 124 and 104 each have a substantially rectangular shape and are substantially in parallel. Similarly, the inner upper wall 122 and the inner lower wall 123 each have a substantially rectangular shape and are substantially in parallel. The exemplary channel 190 has a rectangular cross section although other shapes can be used without departing from the scope and spirit of the present invention.

The radiating element 100 includes a dielectric substrate 160 having a first side 161 and a second side 163 opposite the first side 161. The dielectric substrate 160 can be constructed from any suitable dielectric material, such as a polymer, plastic, TEFLON (fluorocarbon solid), fiber reinforced TEFLON, and the like. The dielectric substrate 160 is disposed in the channel 190 and protrudes out of the waveguide 105 through the opening 125 in the front end 106. Although the portion of the dielectric substrate disposed in the channel 190 has a substantially triangular shape, other shapes are feasible.

A ground plane 165 made from an electrically conductive material covers at least a portion of the second side 163 of the dielectric substrate 160. The dielectric substrate 160 is positioned in the channel 190 such that the ground plane 165 faces the inner lower wall 123 while the first side 161 faces the interior of the channel 190. In certain exemplary embodiments, the ground plane 165 covers the portion of the second side 163 disposed in the channel 190, while at least a portion of the second side protruding out of the waveguide 105 is not covered by the ground plane 165. This allows for a portion or a strip of ground plane 165 material to be extended from the waveguide 105 to form a dipole leg 153 as discussed in further detail below.

A microstrip (or stripline) transmission line 140 made of an electrically conductive material is formed on the first side 161 of the dielectric substrate 160. The microstrip transmission line 140 is configured in an end-launch configuration whereby the propagation direction of an electromagnetic wave propagating in the waveguide 105 is collinear with the microstrip transmission line 140. That is, the microstrip transmission line 140 runs in a direction from the rear end 107 towards the front end 106.

The microstrip transmission line 140 extends through the opening 125 and is turned at a ninety degree angle along the width of the dielectric substrate 160 to form a first dipole leg 151. As briefly discussed above, a portion of the ground plane 165 or a strip of ground plane material or another electrically conductive material extends from the ground plane 165 through the opening 125 along the second side 163 of the dielectric substrate 160. This strip is turned at a ninety degree angle along the width of the dielectric substrate 160 and opposite that of the first dipole leg 151 to form the second dipole leg 153. The two dipole legs 151 and 153 form a dipole radiator 155 that radiates electromagnetic waves having a polarization rotated 90 degrees with respect to the polarization of electromagnetic waves propagating in the waveguide 105 from the rear end 107 towards the front end 106 as discussed in further detail below. The dipole radiator 155 also receives electromagnetic waves propagating in the open space outside the waveguide 105.

The microstrip transmission line 140 can include a transformer for impedance matching between the microstrip 140 and the dipole radiator 155. In the illustrated embodiment, the microstrip transmission line 140 includes a transformer made up of four microstrip segments 140*a*, 140*b*, 140*c*, and 140*d* having differing widths. In this configuration, the width of the microstrip transmission line 140 decreases in steps from a first segment 140*a* closest to the rear end 107 to a last segment 140*d* that forms the first dipole leg 151. That is, the width of segment 140*a* is greater than the width of segment 140*b*; the width of segment 140*b* is greater than the width of segment 140*c*; and the width of segment 140*c* is greater than the width of segment 140*d*. Although in the illustrated embodiment, the microstrip transmission line 140 includes four microstrip segments 140*a*-140*d*, this number is exemplary rather than limiting and any number of microstrip segments may be used in alternative exemplary embodiments.

In certain exemplary embodiments, the length of each microstrip segment 140*a*-140*d* can be determined based upon the wavelength of electromagnetic waves that will be radiated by the radiating device 100. For example, the length of each microstrip segment 140*a*-140*d* may be ¼ the wavelength of the electromagnetic waves. This length provides cancellation or suppression of electromagnetic waves reflected by a surface of each of the microstrip segments 140*a*-140*d* facing the rear end 107. For example, an electromagnetic wave reflected from a leading edge of the microstrip segment 140*a* and propagating toward the rear end 107 would have a ¼ wavelength difference than an electromagnetic wave reflected by the leading edge of microstrip segment 140*b* and propagating toward the rear end 107. At any given position between the leading edge of segment 140*a* and the rear end 107, the two electromagnetic waves will be approximately 180 degrees out of phase, and essentially cancel.

In certain alternative embodiments, rather than step changes in width, the microstrip 140 can have a width that decreases gradually in the direction of the dipole radiator 155. The rate of width reduction can be designed such that reflected electromagnetic waves are reduced or minimized, similar to that of the illustrated embodiment.

In certain alternative embodiments, rather than reducing the width as the transmission line 140 extends in the direction of the front end 106, the width of the transmission line 140 may be substantially the same for the entire length of the transmission line 140 or a substantial portion of this length. In certain alternative embodiments, the width of the transmission line 140 may increase as the transmission line 140 extends toward the front end 106. This increase in width may be gradual or step-wise. For example, in certain exemplary embodiments, the width of segment 140*a* may be less than the width of segment 140*b*; the width of segment 140*b* may be less than the width of segment 140*c*; and the width of segment 140*c* may be less than the width of segment 140*d*.

The exemplary radiating element 100 also includes a waveguide septum 130 that guides the electric field of electromagnetic waves propagating in the waveguide 105 (from the rear end 107 towards the front end 106) into the microstrip transmission line 140 and provides impedance matching between the waveguide 105 and the microstrip 140. The waveguide septum 130 can be fabricated from a metallic material or another material having a conductive finish on the surfaces exposed in the channel 190.

The waveguide septum 130 is disposed above a portion of the microstrip transmission line 140 and extends from the inner upper wall 122 to the microstrip transmission line 140 making contact with the microstrip transmission line section 140*a*, effectively reducing the height of the channel 190 to the thickness of the microstrip substrate. The waveguide septum 130 can gradually or step-wise reduce the height of the channel 190 above the microstrip transmission line 140 in the direction of propagation for the waveguide 105. That is, the distance between a lower surface of the waveguide septum 130 and the microstrip transmission line 140 can decrease from the waveguide septum side closest to the rear end 107 to the waveguide septum side closest to the front end 106.

The illustrated waveguide septum 130 includes two septum segments 132 and 133 (FIGS. 1 & 2) having differing heights (distance from upper inner surface 122) that successively guide the electric field of electromagnetic waves into the microstrip transmission line 140. That is, the first septum segment 132 reduces the height of the channel 190 above the microstrip 140 by a first amount and the second septum segment 133 reduces the height of the channel 190 above the microstrip transmission line 140 by a second amount, such that the final reduced height is substantially equal to the substrate thickness of the microstrip transmission line 140. That is, the second septum segment 133 can make contact with the microstrip transmission line 140.

The waveguide septum 130 can be disposed in the channel 190 with a length between a first surface 131 (FIGS. 1 & 2) of the waveguide septum 130 perpendicular to the waveguide's direction of propagation and a second surface 134 (FIGS. 1 & 2) of the waveguide septum 130 perpendicular to the waveguides direction of propagation based upon the wavelength of electromagnetic waves propagating in the waveguide 105. For example, the length between the first surface 131 and the second surface 134 may be ¼ wavelength so that electromagnetic waves reflecting from the first surface 131 are approximately 90 degrees out of phase with the electromagnetic waves reflecting from the second surface 134. At any position between the first surface 131 and the rear end 107 the two electromagnetic waves will be approximately 180 degrees out of phase, and essentially cancel. This reflective property of the waveguide septum 130 provides impedance matching between the waveguide 105 and the microstrip transmission line 140.

Figure 4:
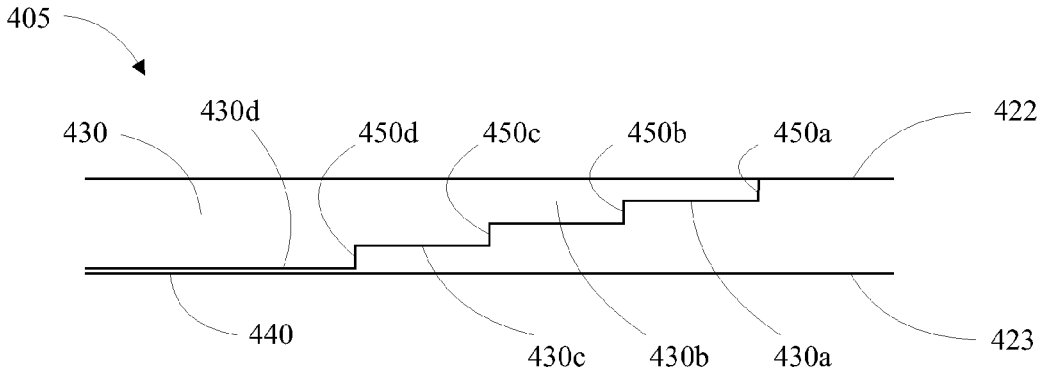
FIG. 4 is a cross-sectional view of a waveguide septum disposed in a waveguide, in accordance with certain exemplary embodiments.

Although the illustrated embodiment includes two septum segments 132 and 133, any number of septum segments can be used in alternative exemplary embodiments. For example, FIG. 4 is a cross-sectional view of a septum 430 disposed in a waveguide 405 having an upper inner wall 422 and a lower inner wall 423, in accordance with certain exemplary embodiments. Referring now to FIG. 4, the exemplary waveguide septum 430 includes four septum segments 430*a*, 430*b*, 430*c*, and 430*d* that guide the electric field of electromagnetic waves into a microstrip transmission line 440. The length of each of the septum segments 430*a*, 430*b*, 430*c*, and 430*d* and the lengths between septum surfaces 450*a*, 450*b*, 450*c*, and 450*d* can be sized such that electromagnetic waves reflected from each surface 450*a*, 450*b*, 450*c*, and 450*d* cancel each other, as described above.

In certain alternative embodiments, rather than step changes in height, the waveguide septum 430 can have a height that increases gradually in the direction of propagation of the waveguide 405. The rate of increase can be designed such that reflected electromagnetic waves are minimized, similar to that of the illustrated embodiment.

Referring back to FIG. 1, in certain exemplary embodiments, the waveguide septum 130 can have a width substantially equal to the width of the first microstrip segment 140*a*, greater than the width of the first microstrip segment 140*a*, or less than the width of the first microstrip segment 140*a*. In certain exemplary embodiments, the waveguide septum 130 can be positioned in the waveguide 105 such that the last septum segment 133 (the septum segment closest to the front end 106) is disposed substantially over the first microstrip segment 140*a* (closest to the rear end 107). In certain alternative embodiments, the waveguide septum 130 can be positioned in the waveguide 105 such that the last septum segment 133 extends past the microstrip transmission line 140 towards the rear end 107. In certain alternative embodiments, the waveguide septum 130 can be positioned in the waveguide 105 such that the microstrip transmission line 140 extends past the last septum segment 133 towards the rear end 107. In certain exemplary embodiments, the last septum segment 133 can extend substantially to the opening 125 or through the opening 125.

The exemplary radiating element 100 also includes two optional fences 171 and 173 disposed on either side of the opening 125. The fences 171 and 173 can be made of a conductive material or other material operable to block electromagnetic waves propagating in the waveguide 105 from exiting the waveguide 105 through the fences 171 and 173. This prevents cross-polarized radiation from leaving the waveguide 105.

The exemplary radiating element 100 includes a waveguide to dipole transition including a waveguide septum 130, a microstrip transmission line 140, and a dipole radiator 155 having a first dipole leg 151 formed from the microstrip transmission line 140 and a second dipole leg 151 formed using a strip of the ground plane 165. The radiating element 100 can rotate the polarization of an electromagnetic wave, such as a TE10 rectangular waveguide mode electromagnetic wave, delivered to the opening 121 in the rear end 107 and propagating from the rear end 107 towards the front end 106. The electromagnetic wave is guided into the microstrip transmission line 140 by the waveguide septum 130, which also provides impedance matching between the waveguide 105 and the microstrip transmission line 140. Additional impedance matching between the microstrip transmission line 140 and dipole radiator 155 is achieved by a transformer in the microstrip transmission line 140 leading to the dipole radiator 155. This transformer is formed using gradual or step-wise changes in width of the microstrip transmission line 140.

The energy in the microstrip 140 is transmitted to the dipole legs 151 and 153 and the dipole radiator 155 can radiate an electromagnetic wave having a polarization oriented along its long dimension, which is the dimension extending from the end of dipole leg 151 to the end of dipole leg 153. This polarization is rotated 90 degrees with respect to the polarization of electromagnetic waves that may be radiated by the waveguide not having a waveguide to dipole transition as a waveguide typically radiates electromagnetic waves having linear polarization oriented along the short dimension of the waveguide's front end 106, which is along the height of the front end 106. Thus, the waveguide to dipole transition provides a 90 degree rotation of the polarization of electromagnetic waves propagating in the waveguide 105.

The radiating element 100 can also rotate the polarization of an electromagnetic wave received by the dipole radiator 155. The dipole radiator 155 can receive electromagnetic waves, for example having a polarization oriented along the dipole radiator's long dimension (i.e., the dimension extending from the end of dipole leg 151 to the end of dipole leg 153). The dipole radiator 155 propagates the received electromagnetic wave into the microstrip transmission line 140 and the microstrip transmission line 140 propagates the electromagnetic wave into the waveguide 105. The waveguide septum 130 guides the electromagnetic wave out of the microstrip transmission line 140 and into the channel 190. The electromagnetic wave propagates in the channel 190 towards the rear end 107 where the electromagnetic wave is delivered to the opening 121. This electromagnetic wave delivered to the opening 121 has a polarization oriented along the short dimension of the opening 121, which is the dimension extending from the lower inner wall 123 and upper inner wall 122. Thus, the polarization of the electromagnetic wave delivered to the opening 121 is rotated 90 degrees with respect to the polarization of the electromagnetic wave received by the dipole radiator 155.

Figure 5:
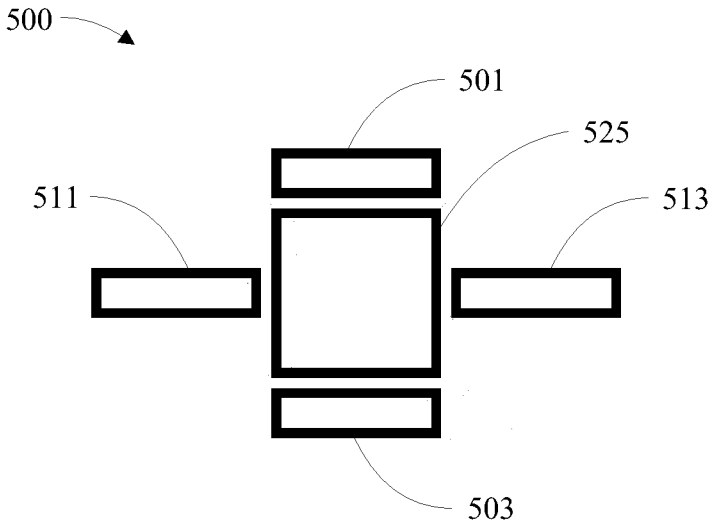
FIG. 5 is a block diagram depicting a five horn, dual-monopulse feed for a reflector system, in accordance with certain exemplary embodiments.

FIG. 5 is a block diagram depicting a five horn, dual-monopulse feed 500 for a reflector system, in accordance with certain exemplary embodiments. Referring to FIG. 5, the feed 500 facilitates a simple method for producing a dual-monopulse feed for a reflector antenna system. The exemplary feed includes a central, square horn antenna 525 that can be used with a reflector, such a trans-twist reflector, to form a pencil beam pattern for a radio link, such as in a radar or a communications link. The feed 500 also includes two rectangular horn antennas 501 and 503 that are fed out of phase to form a difference pattern in the E-plane cut direction. The feed also includes two rectangular horn antennas 511 and 513 that are phased to form a difference pattern in the H-plane cut direction. The difference patterns are used to provide E-plane and H-plane tracking signals to a positioning system that points the pencil beam towards a desired target. One deficiency of the feed 500 illustrated in FIG. 5 is that the phase centers of the left and right horn antennas 511 and 513, respectively may be spaced too far apart to properly illuminate the reflector. One attempt to solve this problem would be to rotate the horn antennas 511 and 513 90 degrees and reposition the horn antennas 511 and 513 for proper spacing. However, this rotation causes a rotation in the polarization of the horn antennas 511 and 513, thus making the polarization incorrect for the intended application. That is, the polarization of horn antennas would be rotated from a vertical orientation as shown in FIG. 5 to a horizontal orientation.

Figure 6:
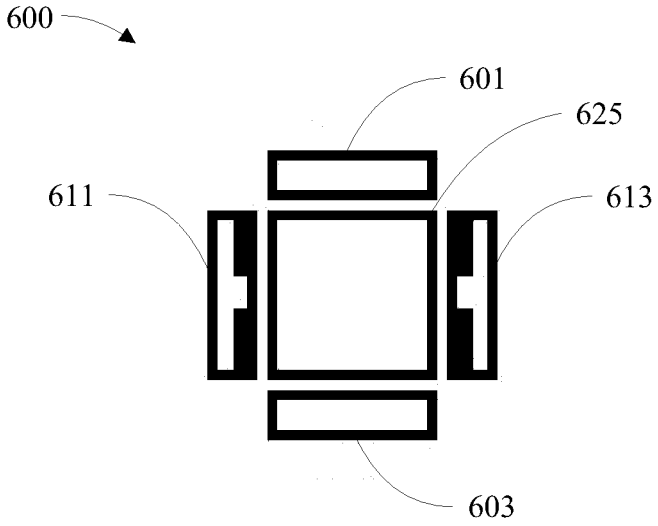
FIG. 6 is a block diagram depicting a five horn, dual-monopulse feed employing waveguide to dipole transitions, in accordance with certain exemplary embodiments.
Figure 7:
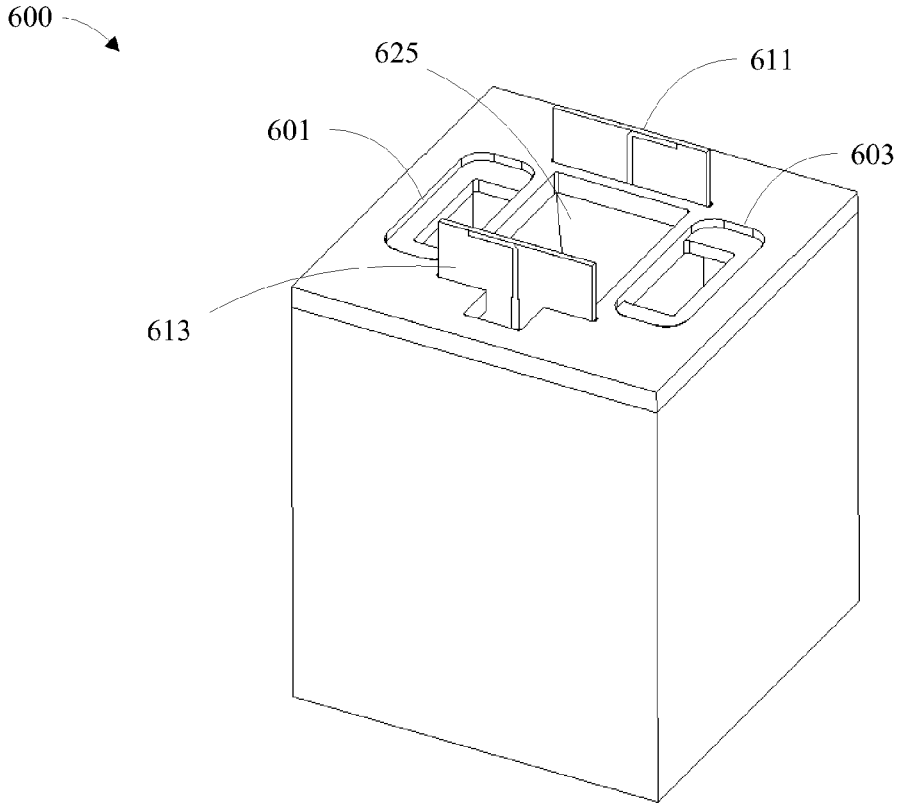
FIG. 7 is an isometric view of the five horn, dual-monopulse feed employing waveguide to dipole transitions of FIG. 6, in accordance with certain exemplary embodiments.

The waveguide to dipole transition illustrated in FIGS. 1-4 and discussed above enables the re-orientation of the horns 511 and 513 while maintaining desired polarization. For example, FIGS. 6 and 7 depict a five horn, dual-monopulse feed 600 employing waveguide to dipole transitions, in accordance with certain exemplary embodiments. In particular, FIG. 6 provides a block diagram depicting an end of the exemplary five horn, dual-monopulse feed 600 and FIG. 7 provides an isometric view of the five horn, dual-monopulse feed 600.

Referring to FIGS. 6 and 7, the exemplary five horn, dual-monopulse feed 600 includes a central horn antenna 625, and two rectangular horn antennas 601 and 603 that are substantially the same as or similar to the central horn antenna 525 and the two rectangular horn antennas 501 and 503 of FIG. 5, respectively. That is, the central horn antenna 625 can be used with a reflector, such as a trans-twist reflector, to form a pencil beam pattern for a radio link, such as in a radar or communications link. The two rectangular horn antennas 601 and 603 can be fed out of phase to form a difference pattern in the E-plane cut direction. The exemplary feed 600 also includes radiating elements 611 and 613 having a waveguide to dipole transition, similar to the radiating feed 100 of FIGS. 1-3. This allows the radiating elements 611 and 613 to be positioned closer to the central horn antenna 625 while having the desired polarization. As the radiating elements 611 and 613 can radiate electromagnetic waves having a polarization oriented in the long dimension of their respective dipole radiators, the radiating elements 611 and 613, as oriented in FIG. 6, would radiate electromagnetic waves having a polarization with a vertical orientation, similar to the horn antennas 511 and 513, as oriented in FIG. 5. The two radiating elements 611 and 613 which include waveguide to dipole transitions can be fed out of phase to form a difference pattern in the H-plane cut direction.

Figure 8:
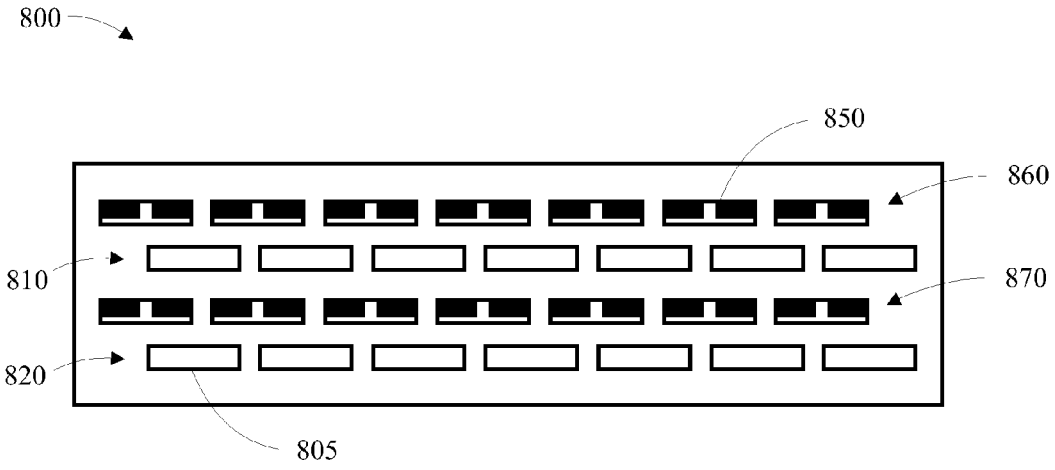
FIG. 8 is a diagram illustrating an array of slot feeds, in accordance with certain exemplary embodiments.

Another application of waveguide to dipole transitions is to rotate the polarization of slot radiators. In arrays of radiators, the spacing between rows may not permit the orientation of slot radiator for proper polarization, which is a common problem for interleaved, simultaneous dual-polarization antennas. In such cases, the illustrated and described transition from waveguide to dipole radiator allows the desired element spacing and polarization rotation. For example, FIG. 8 is a diagram illustrating an array 800 of slot radiators, in accordance with certain exemplary embodiments. Referring to FIG. 8, the exemplary array 800 includes two rows 810 and 820 of waveguide slot radiators 805 and two rows 860 and 870 of radiating elements 850 having a waveguide to dipole transition. Although two rows of each type of radiators 805 and 850 are illustrated in FIG. 8, any number of rows for each type of radiators 805 and 850 is feasible. The radiating elements 850 can be substantially the same as or similar to the radiating element 100 illustrated in FIGS. 1-3.

In the illustrated embodiment, the radiating elements 850 in rows 860 and 870 can radiate electromagnetic waves having a polarization rotated 90 degrees with respect to the polarization of electromagnetic waves radiated by the waveguide radiating elements 805 in rows 810 and 820. Conventionally, to obtain this difference in polarization, waveguide radiating elements may be rotated 90 degrees and arranged in rows alternating with the rows 810 and 820 of waveguide radiating elements 805. However, this change in orientation causes further separation between rows 810 and 820 than that illustrated in FIG. 8 and can also limit the efficiency of the array. The use of the radiating elements 850 allow the rows 810, 820, 860, and 870 to be spaced closer together. This also allows for maximum efficiency from both polarizations, simultaneously. That is, the array of elements 805 with a first polarization can achieve the optimal (or an improved level of) efficiency of the given aperture area, simultaneously with the elements 850 at a second orthogonal polarization.

Although the Figures and specific embodiments above describe a dipole that radiates a polarization oriented 90° relative to the waveguide polarization, other radiated polarizations are possible. For example, referring to FIGS. 1-3, the portion of dielectric substrate 160 that extends outside of the waveguide channel 190 can be replaced by a terminating connector. A wire dipole of arbitrary polarization can be attached to a mating connector and assembled to the terminating connector on the substrate. In an alternate configuration, the portion of dielectric substrate 160 that extends outside of the waveguide channel 190 can be removed and a wire dipole of arbitrary polarization can be directly attached to the substrate 160 by soldering one leg of the dipole to the microstrip transmission line 140 and soldering the other leg of the dipole to the ground plane 165.

Although specific embodiments have been described above in detail, the description is merely for purposes of illustration. It should be appreciated, therefore, that many aspects described above are not intended as required or essential elements unless explicitly stated otherwise. Modifications of, and equivalent acts corresponding to, the disclosed aspects of the exemplary embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. A waveguide to dipole transition, comprising:

a waveguide transmission line;

a first transition that is positioned with respect to the waveguide transmission line to propagate electromagnetic energy between the waveguide transmission line and an electrical transmission line;

wherein the first transition comprises a waveguide septum disposed in a channel of the waveguide and operable to guide electromagnetic waves propagating in the channel into the electrical transmission line; and a second transition that is positioned with respect to the first transition to propagate electromagnetic energy between the electrical transmission line and a dipole radiator;

wherein the dipole radiator is oriented to transmit or receive electromagnetic energy that is polarized orthogonal to a polarization of electromagnetic energy propagating within the waveguide.

2. The waveguide to dipole transition of claim 1, wherein the electrical transmission line comprises a microstrip transmission line.

3. The waveguide to dipole transition of claim 1, wherein the electrical transmission line comprises a stripline transmission line.

4. The waveguide to dipole transition of claim 1, wherein the electrical transmission line comprises an impedance transformer.

5. The waveguide to dipole transition of claim 4, wherein the impedance transformer comprises a gradual change in width of the electrical transmission line in a direction parallel with the direction of propagation of the waveguide.

6. The waveguide to dipole transition of claim 4, wherein the impedance transformer comprises a step-wise change in width of the electrical transmission line in a direction parallel with the direction of propagation of the waveguide.

7. The waveguide to dipole transition of claim 1, wherein the waveguide septum disposed in the channel of the waveguide is tapered in a single plane.

8. The waveguide to dipole transition of claim 7, wherein the waveguide septum is disposed between a wall of the channel and a portion of the electrical transmission line and comprises a plurality of segments providing a step-wise reduction in open space above the electrical transmission line in a direction parallel to the direction of propagation of the waveguide.

9. The waveguide to dipole transition of claim 7, wherein a portion of the waveguide septum contacts a portion of the electrical transmission line.

10. The waveguide to dipole transition of claim 7, wherein the second transition comprises a transformer for matching impedance between the electrical transmission line and the dipole radiator.

11. The waveguide to dipole transition of claim 1, wherein the electrical transmission line is formed on a first side of a dielectric substrate and a ground plane covers at least a portion of a second side of the dielectric substrate opposite the first side.

12. The waveguide to dipole transition of claim 11, wherein the dipole radiator comprises a first dipole leg formed from an end segment of the electrical transmission line and a second dipole leg formed from an electrically conductive strip extending from the ground plane.

13. The waveguide to dipole transition of claim 12, wherein the end segment of the electrical transmission line extends through an opening in the waveguide transmission line and turns 90 degrees to form the first dipole leg.

14. The waveguide to dipole transition of claim 13, wherein the strip extending from the ground plane extends through the opening in the transmission line and turns 90 degrees to form the second dipole leg, the turn of the strip extending from the ground plane being in an opposite direction than the turn of the end segment of the electrical transmission line.

15. The waveguide to dipole transition of claim 1, wherein the channel comprises an opening in one end and at least one waveguide fence disposed proximal the opening in the one end, the at least one waveguide fence operable to block electromagnetic waves propagating between the channel and free space.

16. A method for rotating polarization of electromagnetic energy, comprising:

propagating electromagnetic energy having a first polarization in a waveguide;

transitioning at least a portion of the electromagnetic energy from the waveguide to an electrical transmission line using a waveguide septum disposed in a channel of the waveguide and operable to guide electromagnetic waves propagating in the channel into the electrical transmission line;

transitioning the portion of the electromagnetic energy from the electrical transmission line to a dipole radiator; and radiating, by the dipole radiator, the portion of the electromagnetic energy;

wherein at least a portion of electromagnetic energy radiated by the dipole radiator comprises a second polarization rotated 90 degrees relative to the first polarization.

17. A method for rotating polarization of electromagnetic energy, comprising:

receiving, by a dipole antenna, electromagnetic energy having a first polarization;

transitioning at least a portion of the electromagnetic energy from the dipole antenna to an electrical transmission line;

transitioning the at least a portion of the electromagnetic energy from the electrical transmission line to a waveguide transmission line using a waveguide septum disposed in a channel of the waveguide and operable to guide electromagnetic waves propagating in the electrical transmission line to the waveguide transmission line; and transporting, by the waveguide transmission line, the at least a portion of the electromagnetic energy;

wherein at least a portion of electromagnetic energy transported by the waveguide transmission line comprises a second polarization rotated 90 degrees relative to the first polarization.

18. A waveguide to dipole transition, comprising:

a waveguide comprising a channel and an opening at one end;

an electrical transmission line formed on a first side of a dielectric substrate attached to the waveguide;

a ground plane covering at least a portion of a second side of the dielectric substrate; and a dipole radiator comprising a first dipole leg formed from an end segment of the electrical transmission line and a second dipole leg formed from an electrical conductor electrically coupled to the ground plane;

wherein the dipole radiator is oriented to transmit or receive electromagnetic energy that is polarized orthogonal to a polarization of electromagnetic energy propagating within the waveguide.

19. The waveguide to dipole transition of claim 18, wherein the end segment of the electrical transmission line extends through the opening and turns 90 degrees to form the first dipole leg.

20. The waveguide to dipole transition of claim 18, wherein the electrical conductor extends from the ground plane through the opening and turns 90 degrees in an opposite direction to the turn of the end segment to form the second dipole leg.

21. The waveguide to dipole transition of claim 18, wherein the electrical transmission line comprises a transformer formed using a variation in width of the electrical transmission line.

22. The waveguide to dipole transition of claim 21, wherein the transformer provides impedance matching between the electrical transmission line and the dipole radiator.

23. The waveguide to dipole transition of claim 18, further comprising a waveguide septum disposed in the channel and operable to guide at least a portion of the electromagnetic energy propagating in the waveguide into the electrical transmission line.

24. The waveguide to dipole transition of claim 23, wherein the waveguide septum provides impedance matching between the waveguide and the electrical transmission line.

25. The waveguide to dipole transition of claim 18, wherein the electrical transmission line comprises a microstrip transmission line.

26. The waveguide to dipole transition of claim 18, wherein the electrical transmission line comprises a stripline transmission line.

27. The waveguide to dipole transition of claim 18, wherein the waveguide is operative to feed a monopulse feed.

28. The waveguide to dipole transition of claim 18, wherein the waveguide is operative to feed an element of an array antenna.

* * * * *